US005570661A

United States Patent [19]

Nakamura et al.

[11] Patent Number: 5,570,661

[45] Date of Patent: Nov. 5, 1996

[54] INDUCTION SYSTEM LUBRICANT SYSTEM FOR TWO-CYCLE ENGINES

[75] Inventors: Mitsuyoshi Nakamura; Motohiro Ohshiro, both of Hamamatsu, Japan

[73] Assignee: Sanshin Kogyo Kabushiki Kaisha, Hamamatsu, Japan

[21] Appl. No.: 426,172

[22] Filed: Apr. 21, 1995

[30] Foreign Application Priority Data

Apr. 22, 1994 [JP] Japan ..... 6-084494

[51] Int. Cl.[6] ..... F02B 33/04

[52] U.S. Cl. ..... 123/73 AD; 123/196 R; 184/6.5

[58] Field of Search ..... 123/196 R, 73 AD, 123/184.21; 184/6.5

[56] References Cited

U.S. PATENT DOCUMENTS

| | | | |
|---|---|---|---|
| 3,114,669 | 12/1963 | Herbst | 123/184.21 |
| 3,366,145 | 1/1968 | Lohn | 123/184.21 |
| 3,447,519 | 6/1969 | Marcik et al. . | |
| 3,545,417 | 12/1970 | Yamamoto . | |
| 3,868,929 | 3/1975 | Ishikawa . | |
| 3,908,612 | 9/1975 | Lamm | 123/73 AD |
| 4,414,929 | 11/1983 | Sakurai | 123/73 AD |
| 4,415,507 | 11/1983 | Voliva | 123/184.21 |
| 4,615,305 | 10/1986 | Matsumoto | 123/73 AD |
| 4,632,085 | 12/1986 | Misawa et al. | 123/73 AD |
| 4,716,878 | 1/1988 | Shimada et al. | 123/184.21 |
| 4,856,484 | 8/1989 | Wilson et al. | 123/73 AD |
| 5,020,484 | 6/1991 | Ishikawa et al. | 123/73 AD |
| 5,117,782 | 6/1992 | Bischoff et al. | 123/184.21 |
| 5,195,481 | 3/1993 | Oyama et al. | 184/6.5 |
| 5,349,928 | 9/1994 | Takahashi et al. | 123/73 A |

FOREIGN PATENT DOCUMENTS

| | | | |
|---|---|---|---|
| 1190252 | 4/1965 | Germany | 123/73 AD |
| 64-32010 | 2/1989 | Japan . | |

*Primary Examiner*—David A. Okonsky
*Attorney, Agent, or Firm*—Knobbe, Martens, Oslon & Bear

[57] ABSTRACT

An induction system for a marine propulsion engine wherein the induction system has a flow-controlling valve. A lubricant supply system is provided for delivering lubricant to the induction system upstream of the valve and toward the sliding support surfaces of the valve so as to reduce the likelihood of corrosion, particularly if the fuel supply washes the flow-controlling valve of lubricant during engine running.

16 Claims, 5 Drawing Sheets

INDUCTION SYSTEM LUBRICANT SYSTEM FOR TWO-CYCLE ENGINES

BACKGROUND OF THE INVENTION

This invention relates to an induction system lubricant supply for two-cycle engines and more particularly to an improved lubricant supply for the flow controlling throttle valve of an engine.

As is well known, marine propulsion engines that are utilized in various types of watercraft are subject to problems in conjunction with possible corrosion. This is particularly true with regard to engines which are operated in marine environments.

One area where corrosion can be a problem is in the flow controlling valves positioned in the induction system of the engine. These valves are normally of the butterfly-type, but in any event have a sliding support within the body of the induction system. Frequently the valve is positioned in an area which is downstream of the fuel supply and hence the valve and its sliding support tends to be washed of lubricant by the fuel. As a result, when the engine is shut off, the sliding surfaces are relatively dry and corrosion can occur on the sliding surfaces, which makes operation difficult when the engine is next started.

It is, therefore, a principal object of this invention to provide an improved lubricant supply system for an engine.

It is a further object of this invention to provide a lubricant supply system for an engine wherein the lubricant is supplied so as to lubricate the flow controlling valves of the induction passage.

It is a further object of this invention to provide an improved arrangement for reducing the likelihood of corrosion of the flow controlling valves of an engine induction system.

SUMMARY OF THE INVENTION

This invention is adapted to be embodied in an induction system for a marine propulsion engine that is comprised of an induction passage for supplying a charge to the engine for its operation. A flow controlling valve is positioned in the induction passage and is slidably supported for varying the effective flow area of the induction passage. Means are provided for delivering lubricant to the induction passage at a point upstream of the flow controlling valve and in a direction so as to deliver lubricant to the sliding supporting surfaces of the flow controlling valve.

DETAILED DESCRIPTION OF THE PREFERRED EMBODIMENTS OF THE INVENTION

Figure 1:
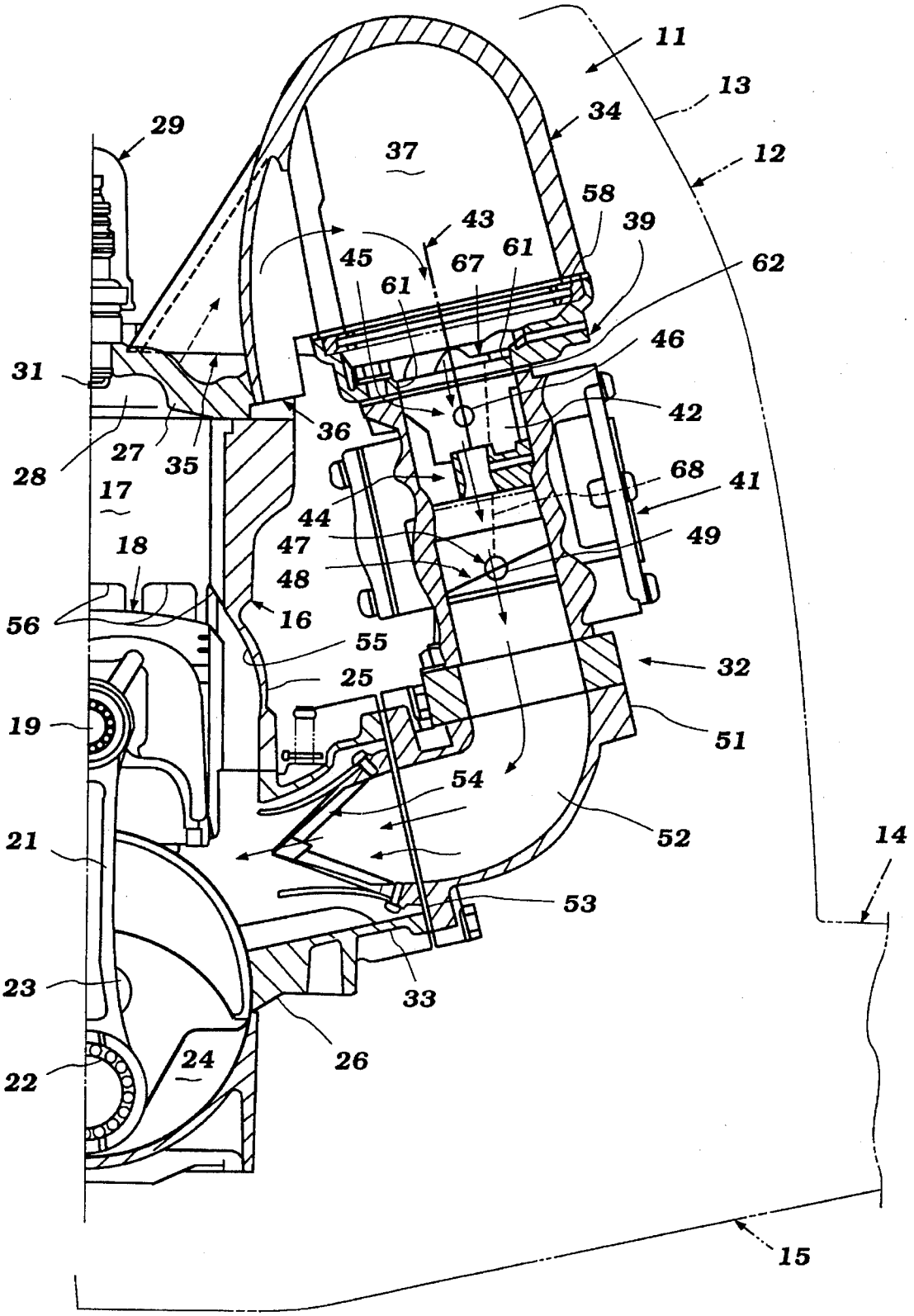
FIG. 1 is a cross-sectional view taken through one-half of a marine propulsion engine constructed in accordance with an embodiment of the invention and showing the associated watercraft partially and in phantom.
Figure 2:
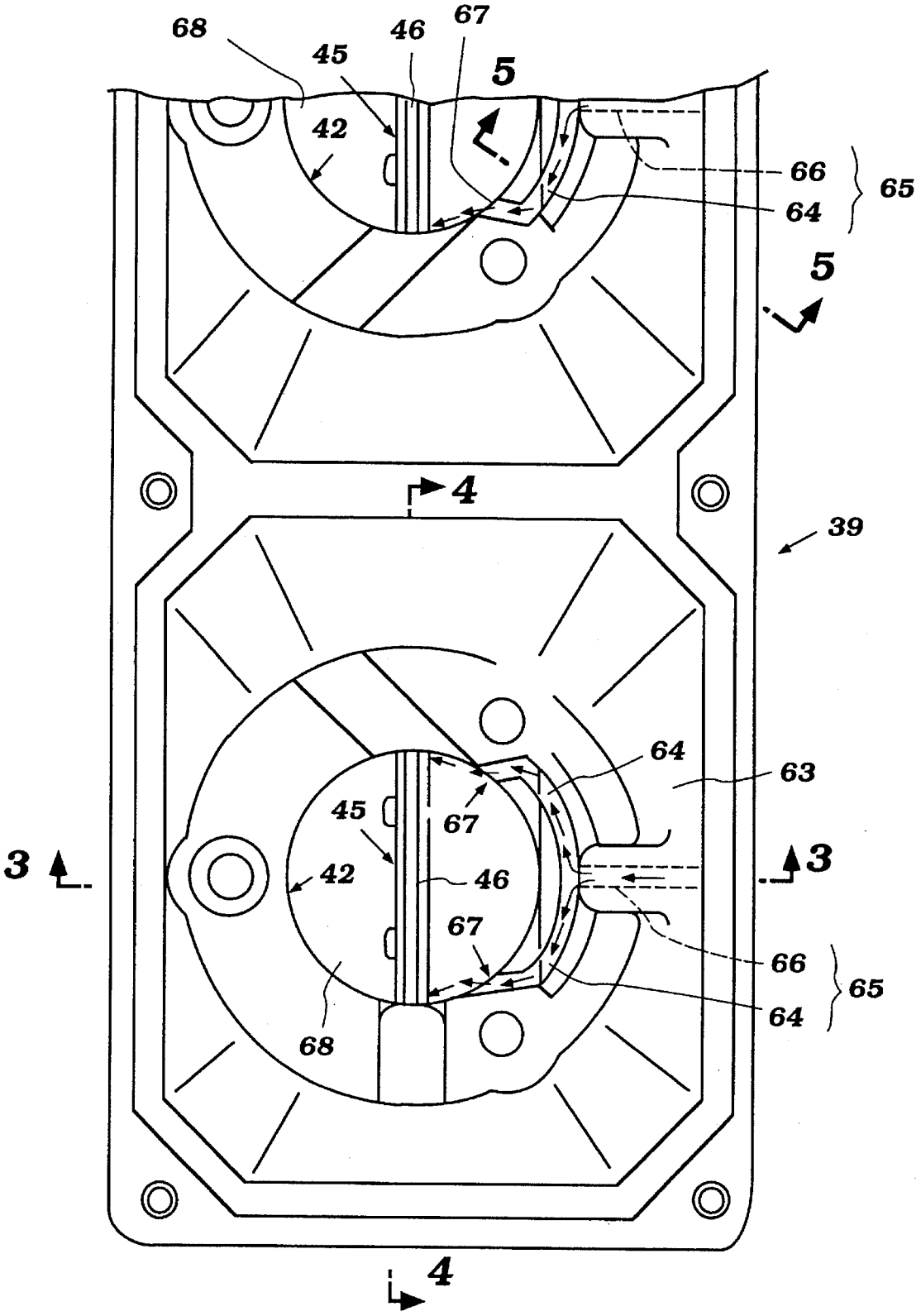
FIG. 2 is a top plan view looking into the throat of the charge forming devices in the area where the lubricant supply system is provided.
Figure 3:
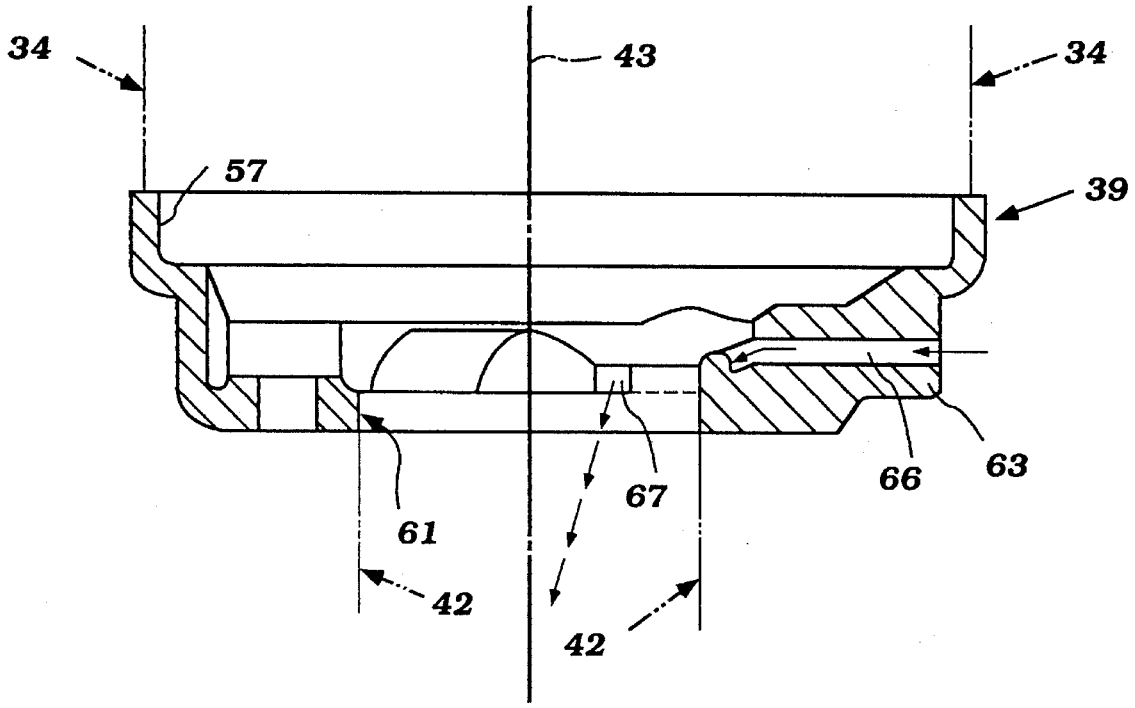
FIG. 3 is an enlarged cross-sectional view taken along the line 3—3 of FIG. 2 and shows only the lubricant supply device.
Figure 4:
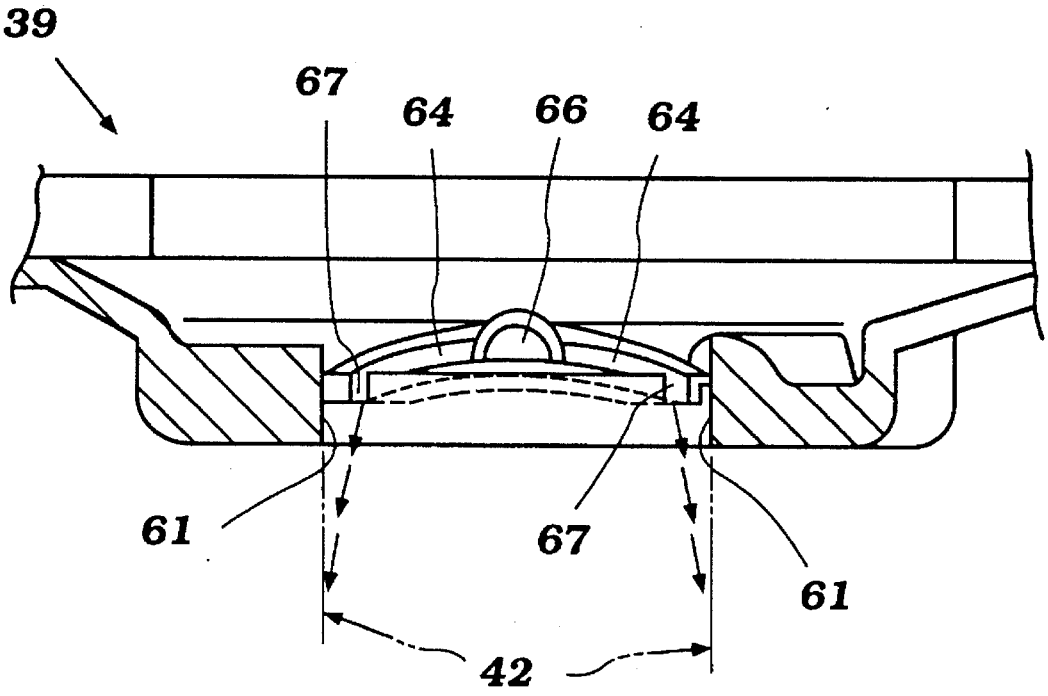
FIG. 4 is an enlarged cross-sectional view taken along the line 4—4 of FIG. 2 and again only shows the lubricant supply device.
Figure 5:
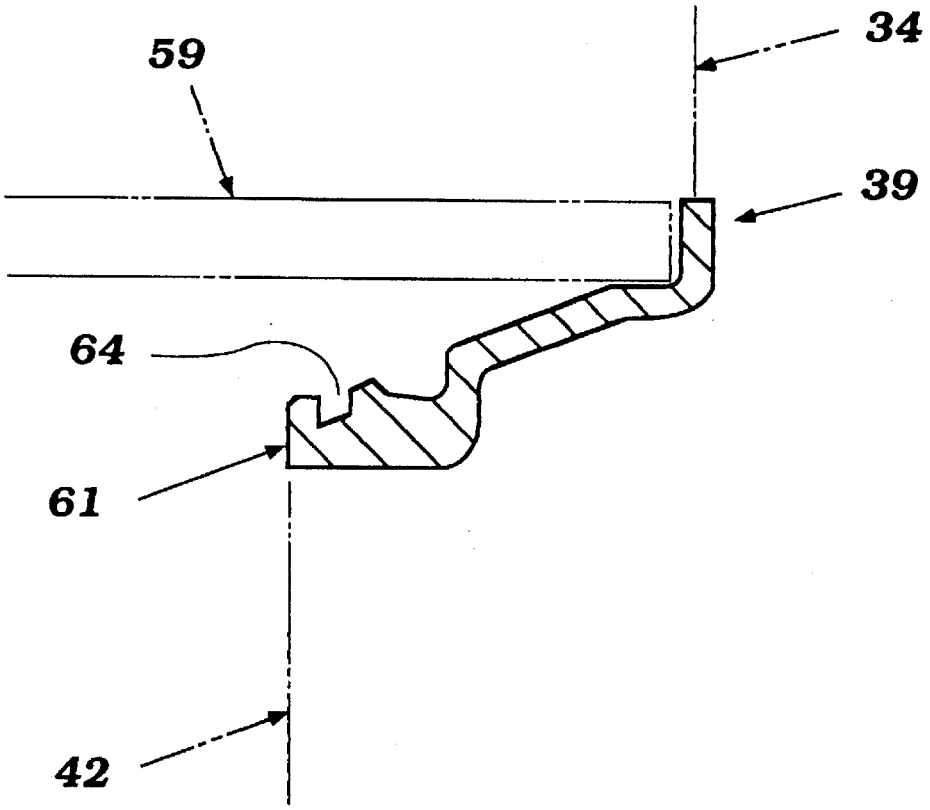
FIG. 5 is an enlarged cross-sectional view taken along the line 5—5 of FIG. 2 and again shows only the lubricant supply device.

Referring now in detail to the drawings and initially primarily to FIG. 1, an internal combustion engine constructed in accordance with an embodiment of the invention is shown partially and in cross-section and identified generally by the reference numeral 11. The engine 11 is, in the illustrated embodiment, of the two-cylinder in-line type and operates on a two-stroke, crankcase compression principle. Although the invention has particular utility in conjunction with such engines, it will be readily apparent to those skilled in the art how the invention may be employed with engines having other cylinder numbers and other cylinder types and also with engines that operate on other than two-stroke crankcase compression principles. Since the invention deals primarily with the induction system for the engine, only a cross-sectional view through one cylinder of the engine is necessary to understand the invention and, in fact, only a cross-section through the intake side of this single cylinder is utilized to describe the invention. It will be readily apparent to those skilled in the art that the invention may be employed in conjunction with any known type of conventional engine.

The invention has particular utility in conjunction with utilization in watercraft propulsion units, and accordingly, a watercraft powered by the engine 11 is shown partially in phantom and is identified generally by the reference numeral 12. The particular watercraft illustrated is of the personal watercraft type. The watercraft 12 includes a centrally positioned raised seat portion 13 on which riders may be seated in straddle-tandem fashion, with foot areas 14 defined on opposite sides of the seat portion 13 by the hull, indicated generally by the reference numeral 15. Again, this description is only so as to permit those skilled in the art to understand the environment in which the invention has particular utility.

The engine 11 is comprised of a cylinder block, indicated generally by the reference numeral 16, in which one or more cylinder bores 17 are formed. Pistons 18 reciprocate in the cylinder bore 17 and are connected by means of piston pins 19 to the upper or small end of connecting rods 21. The lower or big ends 22 of the connecting rods 21 are journalled on a crankshaft 23 that is rotatably journalled within a crankcase chamber 24 formed by a skirt 25 of the cylinder block 16 and a crankcase member 26 that is affixed thereto in a known manner.

A cylinder head 27 is affixed to the cylinder block 16 in a known manner and has recesses 28 that cooperate with the cylinder bores 17 and pistons 18 to form the combustion chambers of the engine 11. Spark plugs 29 are mounted in the cylinder head 27, with their spark gaps 31 disposed in registry with each of the cylinder head recesses 28 for firing the charge therein. The spark plugs 29 are fired by any suitable type of ingition system.

As is typical with two-cycle crankcase compression engines, the crankcase chambers 24 associated with each of the cylinder bores 17 are sealed from each other. An induction system, indicated generally by the reference numeral 32, is mounted on an intake manifold portion 33 formed by the crankcase member 26 for delivering the fuel-air charge to the crankcase chambers.

This induction system 32 includes an air inlet device 34 which is provided with downwardly facing air inlet openings 35 and 36 that are shielded by the engine 11, and specifically the cylinder head 27 and cylinder block 16, so that a clean air charge may be drawn into a plenum chamber 37 formed by the intake device 34 in the direction shown by the arrows 38.

This intake charge is then passed through a lubricant supply adaptor arrangement, indicated generally by the reference numeral 39, which is interposed between the air inlet device 34 and a charge former in the form of a carburetor, indicated generally by the reference numeral 41. There is provided one charge former 41 for each cylinder and crankcase chamber 24 of the engine 11. Of course, other charge-forming arrangements may be employed, but as will be described, the invention has particular utility in conjunction with engines having charge-forming systems that include flow-controlling valves in the induction system.

The charge former 41 is provided with an intake passage 42 that receives air from the air inlet device 34 in a manner which will be described and which has a generally central flow axis 43. A boost venturi 44 is provided in the induction passage 42 downstream of a butterfly-type choke valve 45 for providing the main fuel charge to the induction system 32. The boost nozzle 44 communicates with a main fuel discharge circuit of the carburetor 41. In addition, normal idle and transition circuits may also be provided.

The choke valve 45 is positioned, as is known in this art, upstream of the boost venturi 44 and is of the butterfly type being supported on a choke valve shaft 46 that is journalled in the body of the carburetor 41 in a well-known manner. A suitable remote manual or automatic operator may be provided for operating the choke valve 45 between its closed and open positions.

Downstream of the boost venturi 44 there is provided a flow-controlling throttle valve arrangement 47 which is comprised of a butterfly-type throttle valve 48, which is, in turn, mounted on a throttle valve shaft 49 that is journalled in the body of the carburetor 41 in a known manner. This throttle valve shaft 49 is controlled by a remote operator under the control of the watercraft operator, as is well known in this art.

An intake manifold 51 is provided on the downstream side of the carburetor 41 and receives the fuel-air charge and directs it through a passage 52 to intake ports 53 formed in the crankcase member intake manifold portion 33. Reed-type check valves 54 are provided in each of the intake ports 53 so as to permit the charge to enter the crankcase chambers 24 when they are expanding in volume and to preclude reverse flow when the volume is decreasing and the charge is being compressed.

The compressed charge is then transferred to the combustion chambers through scavenge passages 55 formed in the cylinder block 16 and which terminate in scavenge ports 56. The charge is fired by the spark plugs 29 as aforenoted, and then will be discharged through the exhaust system, which may be of any conventional type, and therefore is not illustrated.

It should be readily apparent that the induction system 32 will be such that the air that is inducted may contain a large amount of water vapor because of the operation in a body of water. This is true, regardless of what protection may be taken to avoid it. In addition, the fuel flowing from the boost venturi nozzle 44 and other discharge circuits of the carburetor 41 will tend to wash not only the throttle valve 48 but also its supporting shaft 49 and the bearing surfaces thereof. Thus, when the engine 11 is shut off, any minerals that may be contained in the water that flows through the induction system will condense on the throttle valve shaft 49 and also on the choke valve shaft 44. When operating in a marine environment, this will mean that salt and other corrosive materials may be present that can cause corrosion. As a result, the throttle valve shaft 49 and choke valve shaft 46 may bind up in subsequent operation.

In order to avoid this problem, the lubricant supply adaptor is provided, and this now will be described by reference to the remaining figures as well as to FIG. 1.

The lubricant supply adapter 39 is, as has been described, an adaptor plate that is interposed between the air inlet device 34 and the carburetors 41. The adaptor device 39 is provided with a flanged opening 57 at its upper end that slidably receives a corresponding flange 58 on the outlet end of the air inlet device 34. A sealing gasket 59 is positioned there between so as to ensure an air tight seal in this area.

At its lower end the adaptor plate or lubricant supply device 39 is provided with a cylindrical discharge opening 61 which registers with the carburetor induction passage 44. A sealing gasket 62 is provided in this area so as to provide an air tight seal.

The body 63 of the lubricant supply adapter 39 is provided with an arcuate lubricant delivery channel 64 which has a curvature which is centered around the induction passage axis 43, but which is spaced transversely outwardly beyond the flow opening 62. This channel 64 provides a portion of a lubricant supply system, indicated generally by the reference numeral 65. Lubricant is supplied to the channel 64 through an inlet passage 66 which opens through the outer portion of the body 63 and which receives lubricant from a lubricant source in metered amounts from any suitable lubricating system. This supply system 65 may either supply all of the lubricant for the engine 11, a substantial portion of it or only a small amount. Primarily, the bulk of the lubricant for the engine will be supplied through the supply system 65.

The arcuate channel 64 terminates in a pair of spaced-apart discharge ends 67 which are disposed adjacent a plane containing the flow axis 43 and the axes of rotation of the choke valve shaft 46 and throttle valve shaft 49. As may be seen by the broken line in FIG. 1, the flow path from the discharge opening 67 is toward the choke valve plate 68 when it is in its closed position, and thus toward the ends of the choke valve shaft 46. In addition, this flow path is directed toward the throttle valve 48, and specifically its throttle valve shaft 49, so as to ensure that adequate lubrication will be supplied to these areas. Hence, when the engine is shut off, there will still be residual lubricant on the shafts that will not have been washed away by the fuel, and thus will ensure that corrosion is not likely to occur.

It should be readily apparent that the described system may be utilized not only in conjunction with carbureted engines, but also engines that are fuel injected, either direct or manifold, as long as they have a flow-controlling throttle valve in their induction passage. Of course, if a fuel injection system is employed and fuel is injected upstream of the throttle valve, the same problems with respect to fuel washing as are true with carburetors will be present. Even if the injector is not positioned in the manifold upstream of the flow-controlling throttle valve, the corrosion problem still may exist, although it may not be as prevalent. In addition to these variations, the invention may also be employed in a number of different environments than that disclosed, which represents only a preferred embodiment of the invention. Such changes and modifications may be made without departing from the spirit and scope of the invention, as defined by the appended claims.

We claim:

1. An induction system for a marine propulsion internal combustion engine, said induction system comprising a body defining an induction passage for delivering at least an air charge to the engine for its combustion, butterfly-type valve is supported upon a valve shaft supported within said induction passage for controlling the flow therethrough, and an adaptor plate affixed to said body at the upstream end thereof and defining a flow passage aligned with said induction passage for delivering lubricant to said induction passage upstream of said butterfly-type valve and in a direction so that the lubricant will impinge upon the valve shaft of said butterfly-type valve.

2. An induction system as in claim 1, wherein the valve comprises a throttle valve.

3. An induction system as in claim 1, wherein the valve comprises a choke valve.

4. An induction system as in claim 3, further including a flow-controlling throttle valve positioned downstream of the choke valve and wherein the lubricant supply is directed toward the flow-controlling throttle valve shaft, as well as the choke valve shaft.

5. An induction system as in claim 1, wherein the adaptor plate is interposed between the induction system body and an air inlet device for the induction system, the lubricant supply system comprising a passage formed in the adaptor plate and terminating in at least a pair of spaced-apart openings extending through its induction passage.

6. An induction system as in claim 5, wherein the valve comprises a throttle valve.

7. An induction system as in claim 5, wherein the valve comprises a choke valve.

8. An induction system as in claim 7, further including a flow-controlling throttle valve positioned downstream of the choke valve and wherein the lubricant supply is directed toward the flow-controlling throttle valve shaft, as well as the choke valve shaft.

9. An induction system as in claim 1, wherein the engine comprises a two-cycle crankcase compression internal combustion engine and the induction system delivers the induction charge to the crankcase chamber of the engine, the lubricating system providing a substantial amount of the lubricant required by the engine for its lubrication.

10. An induction system as in claim 9, wherein the valve comprises a throttle valve.

11. An induction system as in claim 9, wherein the valve comprises a choke valve.

12. An induction system as in claim 11, further including a flow-controlling throttle valve positioned downstream of the choke valve and wherein the lubricant supply is directed toward the flow-controlling throttle valve shaft, as well as the choke valve shaft.

13. An induction system as in claim 9 wherein the adaptor plate is interposed between the induction system body and an air inlet device for the induction system, the lubricant supply system comprising a passage formed in the adaptor plate and terminating in at least a pair of spaced-apart openings extending through its induction passage.

14. An induction system as in claim 13, wherein the valve comprises a throttle valve.

15. An induction system as in claim 13, wherein the valve comprises a choke valve.

16. An induction system as in claim 15, further including a flow-controlling throttle valve positioned downstream of the choke valve and wherein the lubricant supply is directed toward the flow-controlling throttle valve shaft, as well as the choke valve shaft.

* * * * *